US009645528B2

(12) United States Patent
Minato

(10) Patent No.: US 9,645,528 B2
(45) Date of Patent: May 9, 2017

(54) IMAGE FORMING APPARATUS HAVING TONER COLLECTING MODE AFTER STOPPAGE

(71) Applicant: CANON KABUSHIKI KAISHA, Tokyo (JP)

(72) Inventor: Yusuke Minato, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/225,759

(22) Filed: Mar. 26, 2014

(65) Prior Publication Data

US 2014/0294414 A1 Oct. 2, 2014

(30) Foreign Application Priority Data

Apr. 1, 2013 (JP) ..... 2013-075760

(51) Int. Cl.
*G03G 15/16* (2006.01)
*G03G 15/00* (2006.01)

(52) U.S. Cl.
CPC ..... *G03G 15/161* (2013.01); *G03G 15/1675* (2013.01); *G03G 15/70* (2013.01)

(58) Field of Classification Search
CPC ... G03G 15/161; G03G 15/70; G03G 15/1675
USPC ..... 399/66, 101, 358, 360
See application file for complete search history.

(56) References Cited

U.S. PATENT DOCUMENTS 6,321,059 B1 11/2001 Tamura
8,107,834 B2 1/2012 Izumi et al.
8,401,435 B2 3/2013 Shima et al.
2002/0009314 A1* 1/2002 Nakayama ..... G03G 15/168 399/297
2005/0058473 A1* 3/2005 Mizuno et al. ..... 399/302
2005/0191066 A1 9/2005 Yamazaki
(Continued)

FOREIGN PATENT DOCUMENTS

CN 101059674 A 10/2007
CN 101373353 A 2/2009
(Continued)

OTHER PUBLICATIONS

Office Action issued in Chinese Patent Application No. 201410128686.2, dated Dec. 22, 2015.

*Primary Examiner* — Billy Lactaoen
(74) *Attorney, Agent, or Firm* — Fitzpatrick, Cella, Harper & Scinto

(57) ABSTRACT

An image forming apparatus includes an image bearing member; an electrostatic image forming unit; a developing device; an intermediary transfer member; a rotatable transfer member; a constant-voltage element; a power source; a cleaning device; an executing portion capable of executing a toner image collecting mode after jam clearance; and a controller for controlling the power source in an operation in a collecting mode so that a voltage of an identical polarity to a charge polarity of the toner is applied to the rotatable transfer member to transfer, onto the intermediary transfer member, the toner in an upstream-side end region of the toner image carried on the image bearing member with respect to the rotational direction of the image bearing member, and then a voltage of an opposite polarity to the charge polarity of the toner is applied to the rotatable transfer member.

11 Claims, 10 Drawing Sheets

(56) References Cited

U.S. PATENT DOCUMENTS

| | | | | |
|---|---|---|---|---|
| 2006/0245782 | A1* | 11/2006 | Hirai et al. | 399/101 |
| 2008/0292330 | A1* | 11/2008 | Kabashima | G03G 15/161 399/21 |
| 2009/0052921 | A1 | 2/2009 | Nishiwaki | |
| 2010/0272476 | A1 | 10/2010 | Shima et al. | |
| 2013/0195519 | A1 | 8/2013 | Ito et al. | |
| 2014/0093265 | A1* | 4/2014 | Kato | G03G 15/161 399/66 |

FOREIGN PATENT DOCUMENTS

| | | | | |
|---|---|---|---|---|
| JP | 2001-166609 | A | | 6/2001 |
| JP | 2004-198943 | A | | 7/2004 |
| JP | 2006-259640 | A | | 9/2006 |
| JP | 2009115965 | A | * | 5/2009 |
| JP | 2010-256758 | A | | 11/2010 |
| JP | 2012-137733 | A | | 7/2012 |

* cited by examiner

IMAGE FORMING APPARATUS HAVING TONER COLLECTING MODE AFTER STOPPAGE

FIELD OF THE INVENTION AND RELATED ART

The present invention relates to an image forming apparatus in which a toner image is transferred from an intermediary transfer belt onto a recording material.

The image forming apparatus in which the toner image formed on an image bearing member is transferred onto the intermediary transfer belt at a primary transfer portion and then is (re-)transferred onto the recording material at a secondary transfer portion and thereafter the recording material on which the toner image is transferred is heated and pressed to fix the (toner) image thereon has been widely used. In general, as in Japanese Laid-Open Patent Application (JP-A) 2010-256758, the primary transfer portion is formed between the image bearing member and the intermediary transfer belt by sandwiching the intermediary transfer belt by the image bearing member and a rotatable transfer member to which a voltage is to be applied. However, in JP-A 2006-259640, an image forming apparatus in which the rotatable transfer member is omitted and a stretching mechanism of the intermediary transfer belt is simplified has also been proposed.

In the image forming apparatus shown in FIG. 5 of JP-A 2006-259640, an electroconductive layer capable of transmitting a voltage in a circumferential direction is provided on the intermediary transfer belt and the voltage is applied to a rotatable supporting member for stretching the intermediary transfer belt, so that a voltage necessary to transfer the toner image is ensured at the primary transfer portion.

In the image forming apparatus described in JP-A 2010-256758, a transfer residual toner on the image bearing member is collected by rubbing the image bearing member with a cleaning member by an image bearing member cleaning device. Further, in the image forming apparatus described in JP-A 2006-259640, separately from a power source for applying a voltage to the secondary transfer portion, a power source for applying a voltage to the primary transfer portion is provided.

Therefore, not only commonality of these power sources for applying voltages to the secondary and primary transfer portions but also omission of the collecting mode by employing a simultaneous development and cleaning type in which the toner image is formed by the development using the transfer residual toner were provided. As a result, the power source for applying the voltage to the primary transfer portion and the image bearing member cleaning device are not needed, so that downsize of the image forming apparatus is easy.

However, when the commonality of the power sources for applying the voltages to the secondary and primary transfer portions is achieved, during restarting after jam clearance of the restarting, the toner image deposited on the intermediary transfer belt is liable to be deposited on the rotatable transfer member at the secondary transfer portion. There is no image bearing cleaning device, and therefore there is a need to collect the toner image, deposited on the image bearing member, after transferring the toner image from the image bearing member onto the intermediary transfer belt at the primary transfer portion. In this case, the commonality of the power sources is achieved and thus an independent voltage cannot be applied to the secondary transfer portion, and therefore during the transfer of the toner image from the image bearing member onto the intermediary transfer belt at the primary transfer portion, the toner image is transferred from the intermediary transfer belt onto the rotatable transfer member at the secondary transfer portion. As a result, after jam clearance of the recording material, back surface contamination is generated on a back surface of the recording material by transfer of the deposited toner from the rotatable transfer member onto the back surface of the recording material.

SUMMARY OF THE INVENTION

According to an aspect of the present invention, there is provided an image forming apparatus comprising: an image bearing member; an electrostatic image forming unit for forming an electrostatic image on the image bearing member; a developing device for developing the electrostatic image, formed on the image bearing member, into a toner image and capable of collecting a transfer residual toner deposited on the image bearing member; an intermediary transfer member for carrying the toner image primary-transferred from the image bearing member at a primary transfer position; a rotatable transfer member for secondary-transferring the toner image from the intermediary transfer member onto a recording material while sandwiching the recording material between the rotatable transfer member and the intermediary transfer member at a secondary transfer position; a constant-voltage element, electrically connected between the intermediary transfer member and a ground potential, for maintaining a predetermined voltage by flow of a current therethrough; a power source for forming a secondary transfer electric field at the secondary transfer position by applying a voltage to the rotatable transfer member and for forming a primary transfer electric field at the primary transfer position by passing the current through the constant-voltage element; a cleaning device for removing a toner deposited on the intermediary transfer member in a side downstream of the secondary transfer position and upstream of the primary transfer position with respect to a rotational direction of the intermediary transfer member; an executing portion capable of executing, when a main assembly of the image forming apparatus in which a jam of the recording material occurs is stopped and then is restored to a normal state, an operation in a collecting mode in which the toner image carried on the image bearing member when the main assembly is stopped is transferred onto the intermediary transfer member and then is collected by the cleaning device; and a controller for controlling the power source in the operation in the collecting mode so that a voltage of an identical polarity to a charge polarity of the toner is applied to the rotatable transfer member to transfer, onto the intermediary transfer member, the toner in an upstream-side end region of the toner image carried on the image bearing member with respect to the rotational direction of said image bearing member, and then a voltage of an opposite polarity to the charge polarity of the toner is applied to the rotatable transfer member.

These and other objects, features and advantages of the present invention will become more apparent upon a consideration of the following description of the preferred embodiments of the present invention taken in conjunction with the accompanying drawings.

DESCRIPTION OF THE EMBODIMENTS

With reference to the drawings, embodiments of the present invention will be described in detail.

Embodiment 1

Figure 1:
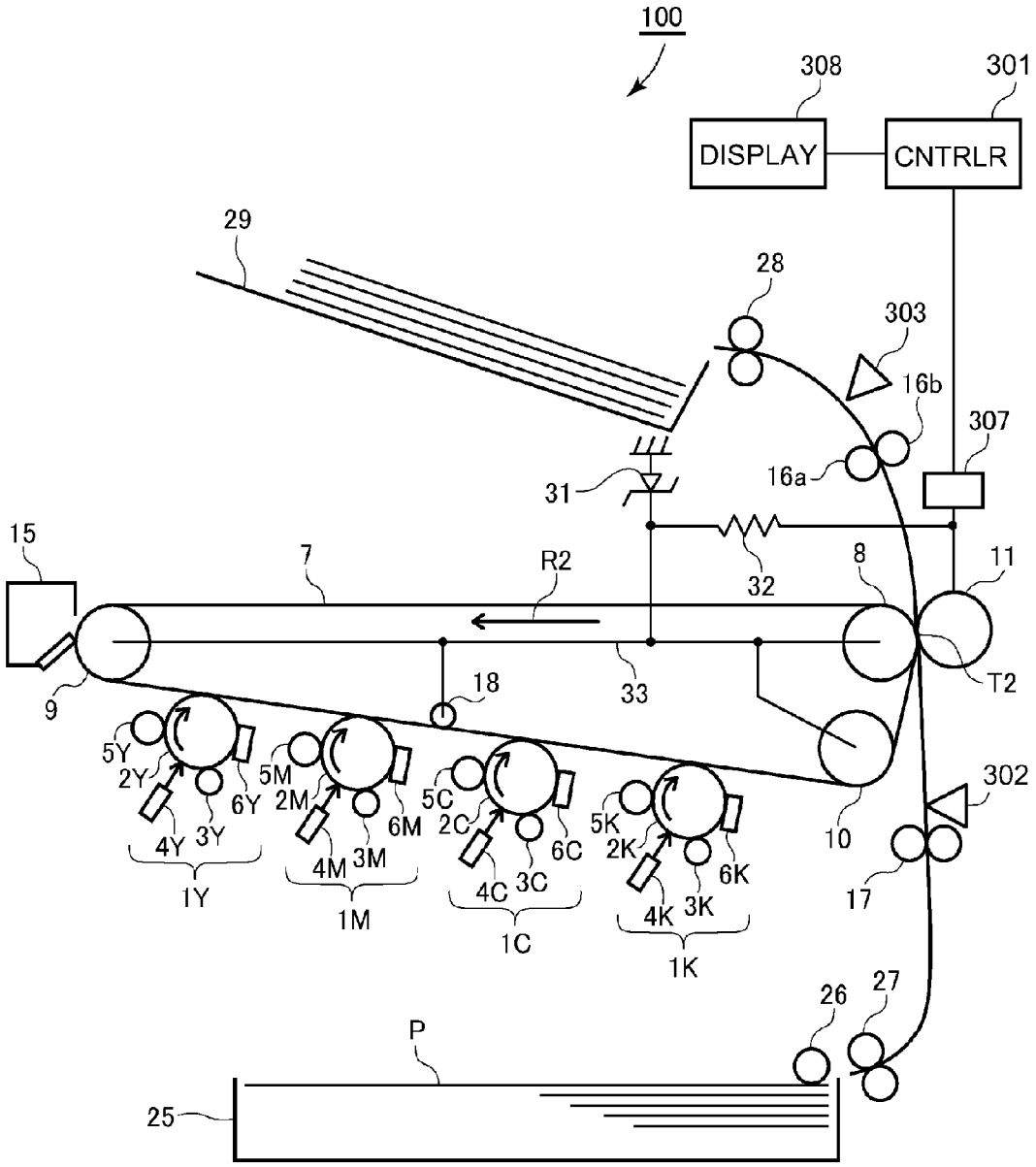
FIG. 1 is an illustration of a structure of an image forming apparatus.

As shown in FIG. 1, at an image forming portion 1K, an exposure device 4K as an example of an electrostatic image forming means forms an electrostatic image on a photosensitive drum 2K as an example of an image bearing member. A developing device 5K as an example of a developing device develops the electrostatic image, formed on the photosensitive drum 2K, into a toner image and at the same time collects a transfer residual toner deposited on the photosensitive drum 2K. Each of image forming portions 1Y, 1M and 1C as an example of an upstream image forming portion forms another toner image on an intermediary transfer belt 7 in an upstream side of a primary transfer position of the image forming portion 1K with respect to a rotational direction of the intermediary transfer belt 7.

Figure 2:
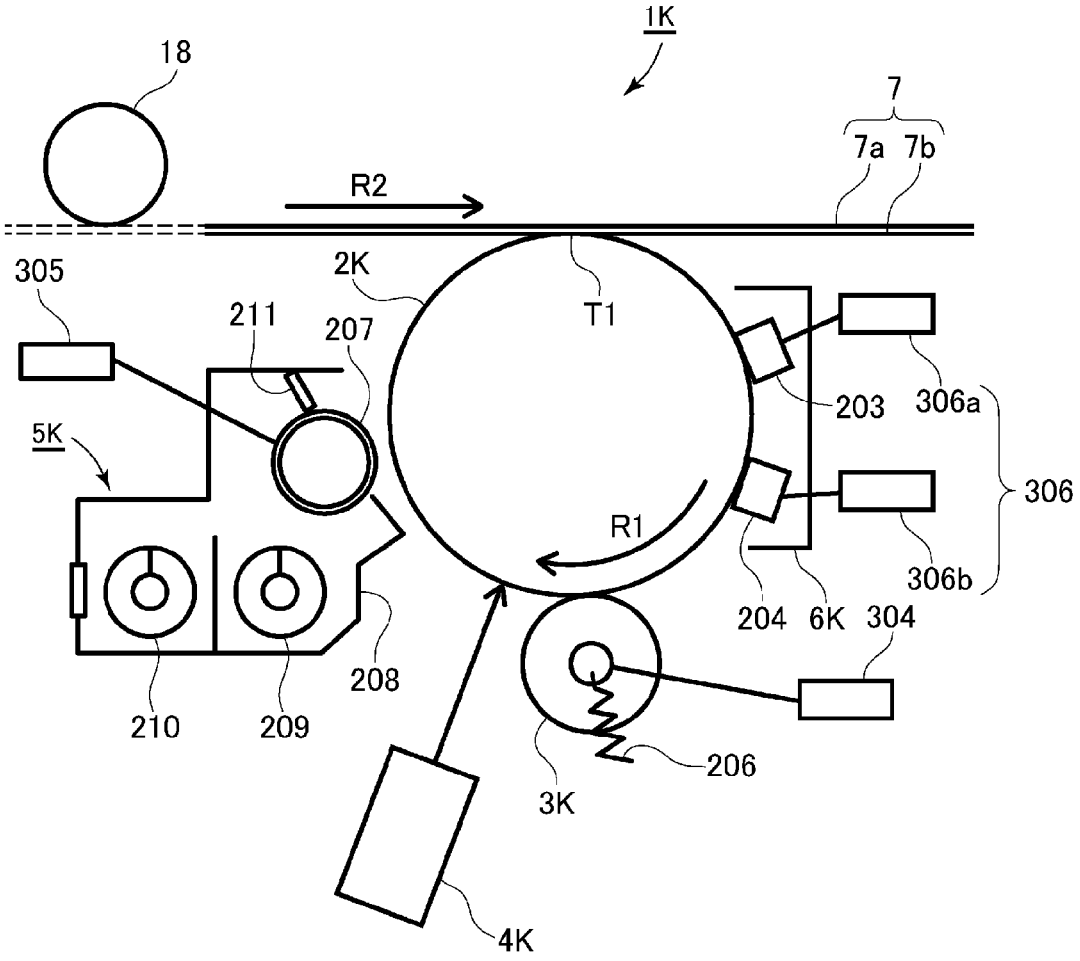
FIG. 2 is an illustration of a structure of an image forming portion.

As shown in FIG. 2, the intermediary transfer belt 7 as an example of an intermediary transfer member carries the toner image primary-transferred from the photosensitive drum 2K at a primary transfer position. The intermediary transfer belt 7 includes an electroconductive layer on an inside thereof and a layer, having a volume resistance higher than the electroconductive layer, on an outside thereof. A secondary transfer roller 11 as an example of a rotatable transfer member rotates at a secondary transfer position while sandwiching a recording material between the secondary transfer roller 11 and the intermediary transfer belt 7 and secondary-transfers the toner image onto the recording material. A belt cleaning device 15 as an example of a cleaning device removes a toner, deposited on the intermediary transfer belt 7, at a side downstream of the secondary transfer position and upstream of the primary transfer position with respect to a rotational direction of the intermediary transfer belt 7.

A Zener diode 31 as an example of a constant-voltage element is electrically connected to between the intermediary transfer belt 7 and a ground potential and maintains a predetermined voltage by a flow of a current therethrough. A secondary transfer inner roller 8 as an example of at least one of a plurality of electroconductive stretching rollers stretches the intermediary transfer belt 7 from the inside of the intermediary transfer belt 7. The Zener diode 31 is electrically connected to the secondary transfer inner roller 8. A secondary transfer high voltage source 307 as an example of a power source means forms a secondary transfer electric field at the secondary transfer position by applying a voltage to the secondary transfer roller 11. The secondary transfer high voltage source 307 forms a primary transfer electric field at the primary transfer position by passing a current through the Zener diode 31.

(Image Forming Apparatus)

FIG. 1 is an illustration of a structure of the image forming apparatus. FIG. 2 is an illustration of a structure of the image forming portion. As shown in FIG. 1, an image forming apparatus 100 is a tandem and intermediary transfer type full-color printer in which image forming portions 1Y, 1M, 1C and 1K for yellow, magenta, cyan and black, respectively, are arranged along a lower (downward) surface of the intermediary transfer belt 7.

At the image forming portion 1Y, a yellow toner image is formed on the photosensitive drum 2Y and then is primary-transferred onto the intermediary transfer belt 7. At the image forming portion 1M, a magenta toner image is formed on a photosensitive drum 2M and is primary-transferred onto the intermediary transfer belt 7. At the image forming portions 1C and 1K, a cyan toner image and a black toner image are formed on photosensitive drums 2C and 2K, respectively, and are successively primary-transferred onto the intermediary transfer belt 7.

The four color toner images transferred on the intermediary transfer belt 7 are conveyed to a secondary transfer portion T2 and then are collectively secondary-transferred onto a recording material P. The recording material P taken out from a recording material cassette 25 is separated one by one by a separation roller 27 and then is fed to a registration roller pair 17. The registration roller pair 17 sends the recording material P to a secondary transfer portion T2 by timing the recording material P to the toner images on the intermediary transfer belt 7. The recording material P on which the (four color) toner images are transferred is heated and pressed by fixing devices 16*a* and 16*b*, so that the toner images are fixed on the surface of the recording material P. Thereafter, the recording material P is discharged onto a discharge tray 29 through a discharging roller pair 28.

The image forming portions 1Y, 1M, 1C and 1K have the substantially same constitution except that the colors of toners (of yellow, cyan, magenta and black) used in associated developing devices are different from each other. In the following description, the black image forming portion 1K will be described with reference to FIG. 2, and, with respect to other color image forming portions 1Y, 1M and 10, redundant description will be omitted.

(Image Forming Portion)

The image forming portion 1K includes, around the photosensitive drum 2K, a charging roller 3K, the exposure device 4K, the developing device 5K, and a toner-recharging device 6K. The photosensitive drum 2K is prepared by forming, on an outer peripheral surface of an aluminum cylinder, a negative chargeable photosensitive layer, and is rotated in an arrow R1 direction at a predetermined process speed (peripheral speed).

To the charging roller 3K, an oscillating voltage in the form of a DC voltage based with an AC voltage is applied from a charging high voltage source 304, so that the surface of the photosensitive drum 2K is electrically charged uniformly to a negative dark portion potential VD by a contact charging scheme (type). The charging roller 3 is held by a bearing at each of end portions of a center shaft formed of metal and is press-contacted to the photosensitive drum 2K at a predetermined pressure by a pressing (urging) spring. The charging roller 3K is rotated by the rotation of the photosensitive drum 2K. The oscillating voltage is in the form of a DC voltage of −700 V biased (superposed) with an AC voltage of a sine wave of 1.3 kHz in frequency and Vpp=1.5 kV in peak-to-peak voltage. The photosensitive drum 2K is charged to the dark portion potential of −700 V which is the same as the DC voltage applied to the charging roller 3K. As a charging member other than the charging roller 3K, it is also possible to use members, such as a fur brush or a felt, having different shape and material.

The exposure device 4K is a laser beam scanner using a semiconductor laser. The exposure device 4K scans the surface of the photosensitive drum 2K with a laser beam through a rotating mirror, thus writing (forming) the electrostatic image for an image on the charged surface of the photosensitive drum 2K. When the surface of the photosensitive drum 2 charged to the dark portion potential VD is subjected to the exposure, the electric charges on the surface of the photosensitive drum 2K are partly canceled, so that the surface potential is lowered to a light portion potential VL.

The developing device 5 develops the electrostatic image with the toner, so that the toner image is formed on the surface of the photosensitive drum 2K. On the other hand, the intermediary transfer belt 7 is maintained at a predetermined potential by grounding the respective stretching rollers via the Zener diode 31. As a result, it is possible to transfer the toner image from the photosensitive drum 2K onto the intermediary transfer belt 7 at the primary transfer portion T1.

(Intermediary Transfer Belt)

The intermediary transfer belt 7 as the intermediary transfer member is disposed so as to pass through between a back-up roller 18 and each of the photosensitive drums 2Y, 2M, 2C and 2K.

As shown in FIG. 1, the intermediary transfer belt 7 is stretched by a driving roller 10, a tension roller 9, the secondary transfer inner roller 8 and the back-up roller 18 and is contacted to the photosensitive drums 2Y, 2M, 2C and 2K at the lower (downward) surface thereof. The intermediary transfer belt 7 receives power of the driving roller 10 driven and rotated by an unshown motor, and thus is rotated in an arrow R2 direction.

The belt cleaning device 15 rubs the surface of the intermediary transfer belt 7, supported by the tension roller 9 at an inside surface, with a cleaning blade, and thus collects a fog toner and a transfer residual toner, which remain on the intermediary transfer belt, passed through the secondary transfer portion T2.

(Developing Device)

As shown in FIG. 2, the developing device 5K is of a two-component contact developing type using a developer (two-component developer) in which a (non-magnetic) toner and a (magnetic) carrier are mixed. The toner is prepared by dispersing a colorant, a charge-control agent and the like in a polyester-based resin material and then by forming a resultant mixture into particles (powder) of about 7 μm in a volume-average particle size. The carrier is about $10^{13}$ Ω·cm in volume resistivity and about 40 μm in particle size.

A developing screw 209 and a stirring screw 210 circulate the developer in a developing container 208 while stirring the developer, so that the toner and the carrier are triboelectrically charged to a positive polarity and a negative polarity, respectively. A developing sleeve 207 magnetically carries the charged developer and forms a magnetic chain of the developer at an opposing portion to the photosensitive drum 2K, and the photosensitive drum 2K is rubbed with an end of the magnetic chain. The developing sleeve 207 is exposed to an outside of the developing device 5K at a part of an outer peripheral surface thereof, and is disposed to keep an opposing distance to the photosensitive drum 2K at 300 μm. An opposing portion between the photosensitive drum 2K and the developing sleeve 207 is a developing portion.

A developing high voltage source 305 applies, to the developing sleeve 207, an oscillating voltage in the form of a DC voltage Vdc biased with an AC voltage Vac, so that the toner having a quality (amount) of electricity corresponding to a differential potential between the DC voltage Vdc and the dark portion potential VD of the photosensitive drum 2K is transferred onto the photosensitive drum 2K. Specifically, to the developing sleeve 207, the oscillating voltage in the form of the DC voltage of −500 V biased with an AC voltage of a rectangular wave of 8.0 kHz in frequency and Vpp=1.8 kV in peak-to-peak voltage is applied. The toner is deposited on a portion where the photosensitive drum 2K is subjected to the exposure to light, so that the electrostatic image is reversely developed. An average charge amount of the toner transferred on the photosensitive drum 2K is about −30 μC/g under a normal temperature and normal humidity environment of room temperature of 23° C. and a relative humidity of 50% RH.

(Constitution for Applying Voltage to Primary Transfer Portion)

As shown in FIG. 1, the image forming apparatus 100 includes no primary transfer member for sandwiching the intermediary transfer belt 7 between the photosensitive drum 2K and the primary transfer member. At an opposing position of the photosensitive drum 2K via the intermediary transfer belt 7, there is no member. The image forming apparatus 100 is not provided with a dedicated power source for applying a voltage to the primary transfer portion. The secondary transfer high voltage source 307 applies, not only to the secondary transfer portion T2 but also to the primary transfer portion T1, the DC voltage for transferring the toner image.

The intermediary transfer belt 7 is supported by the back-up roller 18 between the driving roller 10 and the tension roller 9 and is slightly wound about each of the photosensitive drums 2Y, 2M, 2C and 2K by 2-3 mm to form the primary transfer portion T1.

As shown in FIG. 2, the intermediary transfer belt 7 includes a 100 μm-thick base layer 7*a* in which carbon black is dispersed in polyphenylene sulfide (PPS) resin to adjust a resistance. As the resin material for the base layer 7*a*, polyimide (PI) resin, polyether ether ketone (PEEK) or the like may also be used. A volume resistivity of the base layer 7*a* is about $10^6$ Ω·cm, and when compared with a volume resistivity, of $10^9$ Ω·cm, of a base layer of a conventional intermediary transfer belt, the base layer 7*a* has a remarkably low resistance.

The intermediary transfer belt 7 has a multi-layer structure. Specifically, on an outer surface of the base layer 7*a*, a 1-3 μm-thick high-resistance surface layer 7*b* of acrylic resin is provided. The reason why the high-resistant surface layer 7*b* is used is that a current difference between a sheet-passing region and a non-sheet-passing region at the secondary transfer portion T2 with respect to a longitudinal direction is made small to obviate a variation in secondary transfer property of the toner image onto a small-sized paper.

As shown in FIG. 1, the driving roller 10, the tension roller 9, the secondary transfer inner roller 8 and the back-up roller 18 are not grounded but are connected in common via circuit wiring 33. The circuit wiring 33 is grounded via the Zener diode 31 having the function of keeping the potential of the intermediary transfer belt 7 at a constant level. A resistance 32 lowers an output voltage of a secondary transfer high voltage source 307 and transmits the voltage (potential) to the circuit wiring 33, so that the potential of the secondary transfer high voltage source 307 is kept at Zener potential of the Zener diode 31. Incidentally, the current flows through the secondary transfer portion T2, and therefore the resistance 32 can be omitted.

With respect to the intermediary transfer belt 7, the current flows in a circumferential direction through the low-resistance base layer 7*a*, and therefore the entire full circumference of the intermediary transfer belt 7 becomes equipotential when the secondary transfer high voltage source 307 applies, to the secondary transfer roller 11, a DC voltage for transferring the toner image.

The potential of the intermediary transfer belt 7 at this time is determined by a voltage-current characteristic (Zener voltage) of the Zener diode 31 connected to the circuit wiring 33. In Embodiment 1, the Zener voltage of the Zener diode 31 is selected at 200 V, and therefore the intermediary transfer belt 7 has a potential of +200 V over one-full-circumference thereof. For this reason, by a potential difference between the surface potential of the photosensitive drum 2K and the surface potential of the intermediary transfer belt 7, the toner image is transferred from the photosensitive drum 2K onto the intermediary transfer belt 7.

(Simultaneous Development and Cleaning Constitution)

As shown in FIG. 2, the image forming portion 1K employs a so-called cleaner-less constitution, and therefore the photosensitive drum 2K is not provided with a drum cleaning device such as a cleaning blade.

A transfer residual toner or the like which passes through the primary transfer portion T1 and which remains on the photosensitive drum 2K is adjusted to have a charge amount of a normal polarity in a predetermined range by a toner re-charging device 6K, and thereafter the transfer residual toner is deposited on the developing sleeve 207 and then is collected into the developing device 5K. Alternatively, the transfer residual toner develops the electrostatic image into the toner image by being deposited on the dark portion potential VD region of the photosensitive drum 2K until it passes through the developing portion.

The transfer residual toner on the photosensitive drum 2K, passed through the primary transfer portion T1 without being transferred onto the intermediary transfer belt 7, is charged by an upstream auxiliary charging member 203 and a downstream auxiliary charging member 204 of the toner re-charging device 6K. Each of the upstream auxiliary charging member 203 and the downstream auxiliary charging member 204 is a deck brush-type charging brush which is fixedly provided and which has the same constitution.

Each of the upstream auxiliary charging member 203 and the downstream auxiliary charging member 204 is prepared by planting electroconductive nylon fibers on a supporting plate of metal. The nylon fibers are 6 denier in fineness of fiber, 5 mm in pile length and 100,000 fibers/inch$^2$ in fiber density. Each of the upstream auxiliary charging member 203 and the downstream auxiliary charging member 204 is fixedly disposed on a main assembly frame so that a tip portion of the fibers contacts the photosensitive drum 2K. Each of the upstream auxiliary charging member 203 and the downstream auxiliary charging member 204 rubs the photosensitive drum 2K with the tip portion of the fibers thereof with rotation of the photosensitive drum 2K.

An auxiliary charging member high voltage source 306*a* applies, to the supporting plate of the upstream auxiliary charging member 203, a primary auxiliary charging voltage of an opposite polarity to the normal charge polarity of the toner. The primary auxiliary charging voltage in this embodiment is a DC voltage of +600 V. An auxiliary charging member high voltage source 306*b* applies, to the supporting plate of the downstream auxiliary charging member 204, a secondary auxiliary charging voltage of an identical polarity to the normal charge polarity of the toner. The secondary auxiliary charging voltage in this embodiment is a DC voltage of −1000 V.

The transfer residual toner on the photosensitive drum 2K includes a toner charged to the normal polarity (negative) and a so-called reversely charged toner charged to the opposite polarity (positive) to the normal polarity. Further, in order to electrically efficiently collect the transfer residual toner onto the developing sleeve 207, all the transfer residual toner on the photosensitive drum 2K is required to have the normal polarity (negative) and a uniform charge amount in a predetermined range. For that reason, to the downstream auxiliary charging member 204, the secondary transfer charging voltage which has the identical polarity to the normal charge polarity of the toner and which has a larger absolute value than the primary auxiliary charging voltage is applied.

In this case, in order to uniformly provide all the transfer residual toner with the charge amount which has the identical polarity to the normal polarity (negative) and which falls within the predetermined range, the transfer residual toner including the toners of the normal polarity and the opposite polarity in mixture may preferably be once charged to the opposite polarity (positive) to the normal polarity. For this reason, to the upstream auxiliary charging member 203, the primary auxiliary charging voltage of the opposite polarity (positive) to the normal polarity is applied.

Further, in this embodiment, the secondary auxiliary charging voltage (−1000 V) applied to the downstream auxiliary charging member 204 is made larger in absolute value than the charging voltage (−700 V) applied to the charging roller 3K. This is because the transfer residual toner charged to the normal polarity by the downstream auxiliary charging member 204 is prevented from being transferred from the photosensitive drum 2K onto the charging roller 3K when the transfer residual toner passes through the charging roller 3K to which the charging voltage is applied.

The transfer residual toner subjected to auxiliary charging by the toner re-charging device 6K passes through the charging roller 3K and then reaches a developing position where the developing sleeve 207 and the photosensitive drum 2K oppose to each other. At the developing position, the transfer residual toner is collected by the developing sleeve in response to a fog-removing potential difference Vback which is the potential difference between the dark portion potential VD of the photosensitive drum 2K and the DC voltage Vdc of the developing sleeve 207. In this way, the transfer residual toner on the photosensitive drum 2K is charge-controlled and collected by the developing device 5K, so that a cleaner-less system functions.

$$V\text{back}=-500\text{ V}-(-700\text{ V})=+200\text{ V}$$

Incidentally, the toner re-charging device 6K is not limited to that described above in this embodiment. It is possible to employ any-shaped member, advantageous for charging the toner, such as a fur brush, an elastic roller or a sheet-like electrode member, to be rotationally driven. As a brush material, polyester fibers may also be used and may desirably be 2-10 denier in fineness of fiber, 3-8 mm in pile length and 50,000-500,000 fibers/inch$^2$ in fiber density. In order to enhance a collecting efficiency of the transfer residual toner, the developing sleeve 207 may also be rotated in an opposite direction (counter direction) to the rotational direction of the photosensitive drum 2K.

(Control Constitution)

Figure 3:
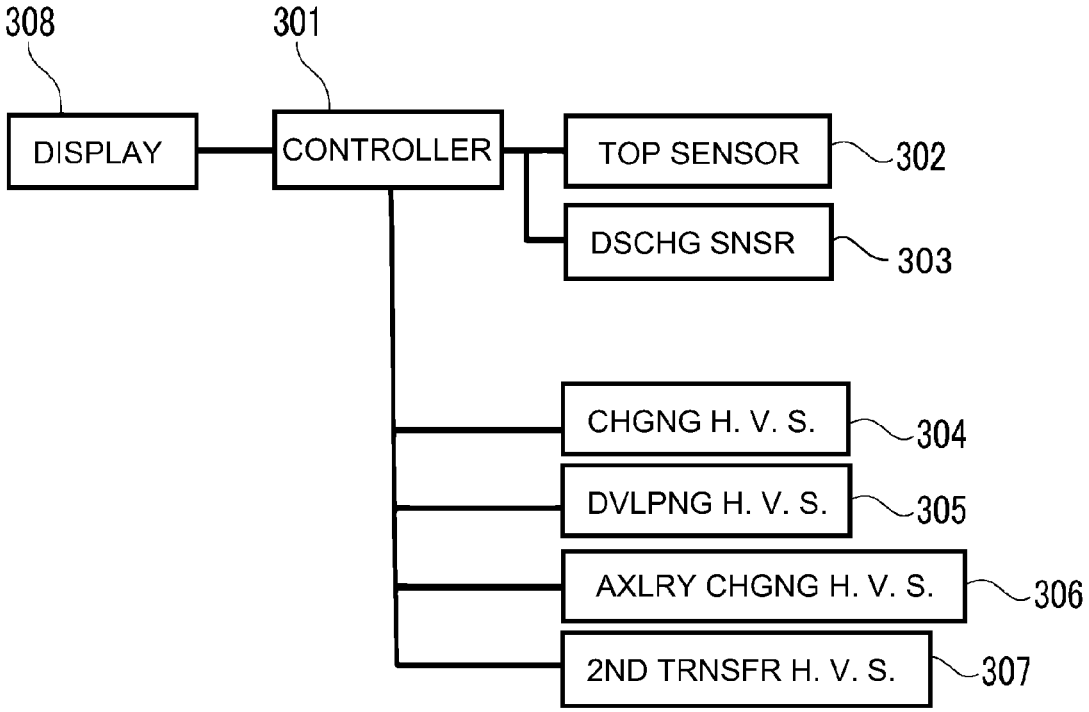
FIG. 3 is a block diagram of a control system of the image forming apparatus.

FIG. 3 is a block diagram of a control system of the image forming apparatus. As shown in FIG. 3 with reference to FIG. 3, the controller 301 effects integrated control of the respective portions of the image forming apparatus 100. To the controller 301, RAM (not shown) used as a memory for an operation and ROM (not shown) in which a program to be executed and various data are stored are connected. A top sensor 302 and a discharge sensor 303 are used for detecting that a jam of the recording material P occurred in a feeding path of the recording material P. The top sensor 302 detects that the recording material P reaches the registration roller pair 17 before entering the secondary transfer portion T2. The discharge sensor 303 detects that the recording material P passes through the fixing device 16 and then is discharged onto the discharge tray 29 through the discharging roller pair 28.

The controller 301 discriminates, in the case where the recording material P is detected by the top sensor 302 and then is not detected by the discharging sensor 303 even after a lapse of predetermined seconds, that the jam of the recording material P occurred and then immediately stops the feeding of the recording material P. An operator opens a casing door of the image forming apparatus 100 and performs jam clearance by a manual operation, and thereafter operates a main (power supply) switch to re-actuate (restart) the image forming apparatus 100.

(Problem Resulting from Common Power Source)

As shown in FIG. 2, the cleaner-less constitution using the toner re-charging device 6K is based on the premise that the amount of the transfer residual toner on the photosensitive drum 2K is small. For this reason, when the toner image remaining on the photosensitive drum 2K during the jam occurrence during the image formation is intended to be re-charged by the toner re-charging device 6K, the toner, in a large amount, which is in an improper charging state passes through the toner re-charging device 6K. When the passing-through of the toner occurs, the charging roller 3K is contaminated with the toner to cause improper charging.

For that reason, in the image forming apparatus 100 having the cleaner-less constitution, there is a need to collect the toner image, remaining on the photosensitive drum 2K during the re-actuation of the image forming apparatus 100 after the jam clearance, by the belt cleaning device 15 by transferring the toner image from the photosensitive drum 2K onto the intermediary transfer belt 7 and then by passing the toner image through the secondary transfer portion T2 as it is. However, the image forming apparatus 100 uses the secondary transfer high voltage source 307 common to the primary transfer portion T1 and the secondary transfer portion T2. For this reason, when the toner image is transferred from the photosensitive drum 2K onto the intermediary transfer belt 7 at the primary transfer portion T1 by applying the positive voltage to the intermediary transfer belt 7, the positive voltage is applied to the secondary transfer roller 11, so that the toner image on the intermediary transfer belt 7 is transferred onto the secondary transfer roller 11. As a result, the toner is deposited on the secondary transfer roller 11, so that back surface (side) contamination of the recording material occurs in the image formation after the re-actuation.

On the other hand, when the negative voltage is applied to the secondary transfer roller 11 so that the toner image on the intermediary transfer belt 7 is not transferred onto the secondary transfer roller 11, the toner image on the photosensitive drum 2K is transferred onto the intermediary transfer belt 7, and thus the toner image cannot be collected by the belt cleaning device 15.

Therefore, in this embodiment, during the re-actuation after the jam clearance, in a process in which the toner images on the photosensitive drum 2K and the intermediary transfer belt 7 are collected by the belt cleaning device 15, a cleaning sequence of the secondary transfer roller 11 is executed. As a result, it becomes possible to collect all the toner images on the photosensitive drum 2K and the intermediary transfer belt 7.

Characteristic Constitution of Embodiment 1

Figure 4:
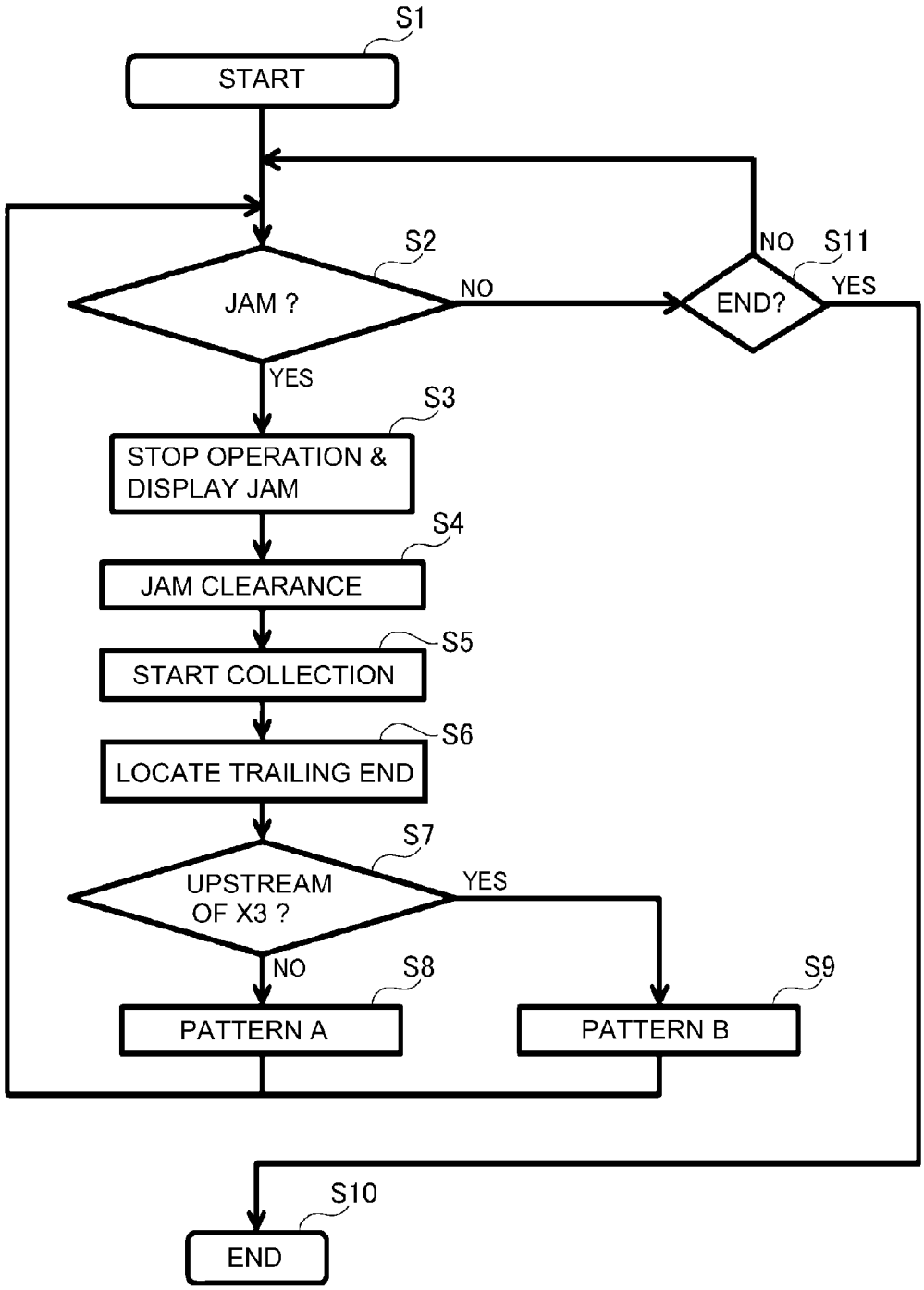
FIG. 4 is a flowchart of control of an operation in a collecting mode to be executed after jam clearance.
Figure 5:
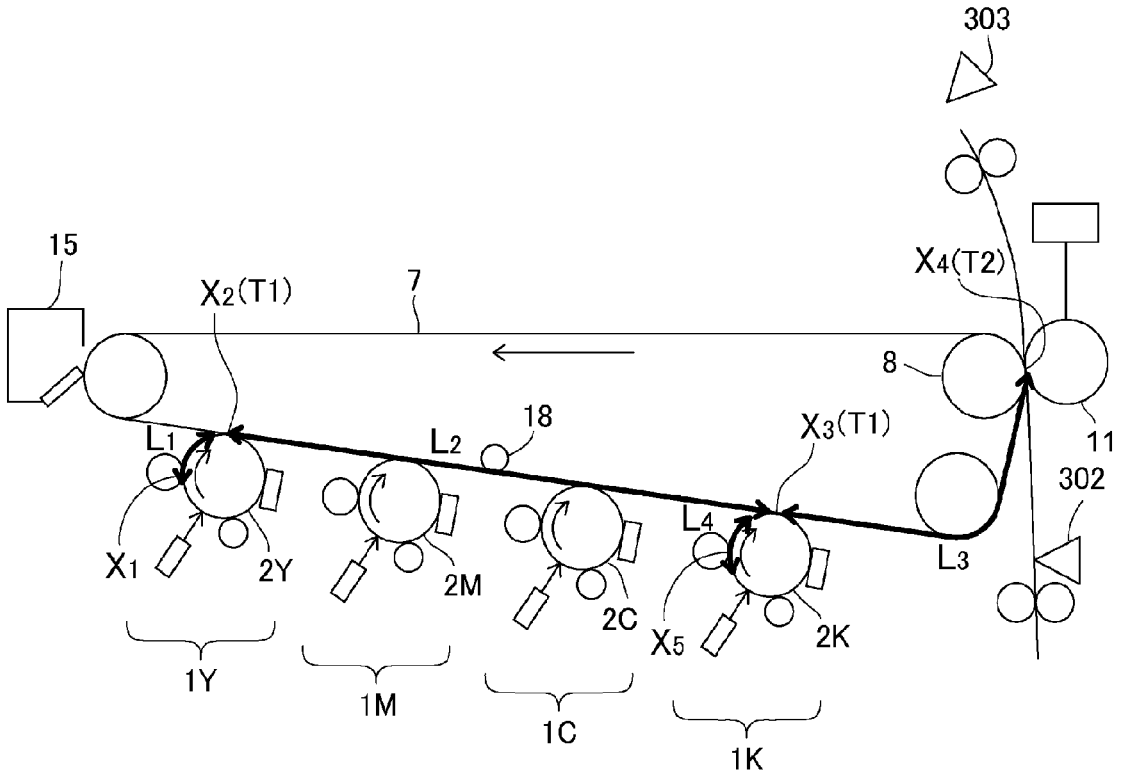
FIG. 5 is an illustration of collecting mode switching control depending on a toner image stop position.
Figure 6:
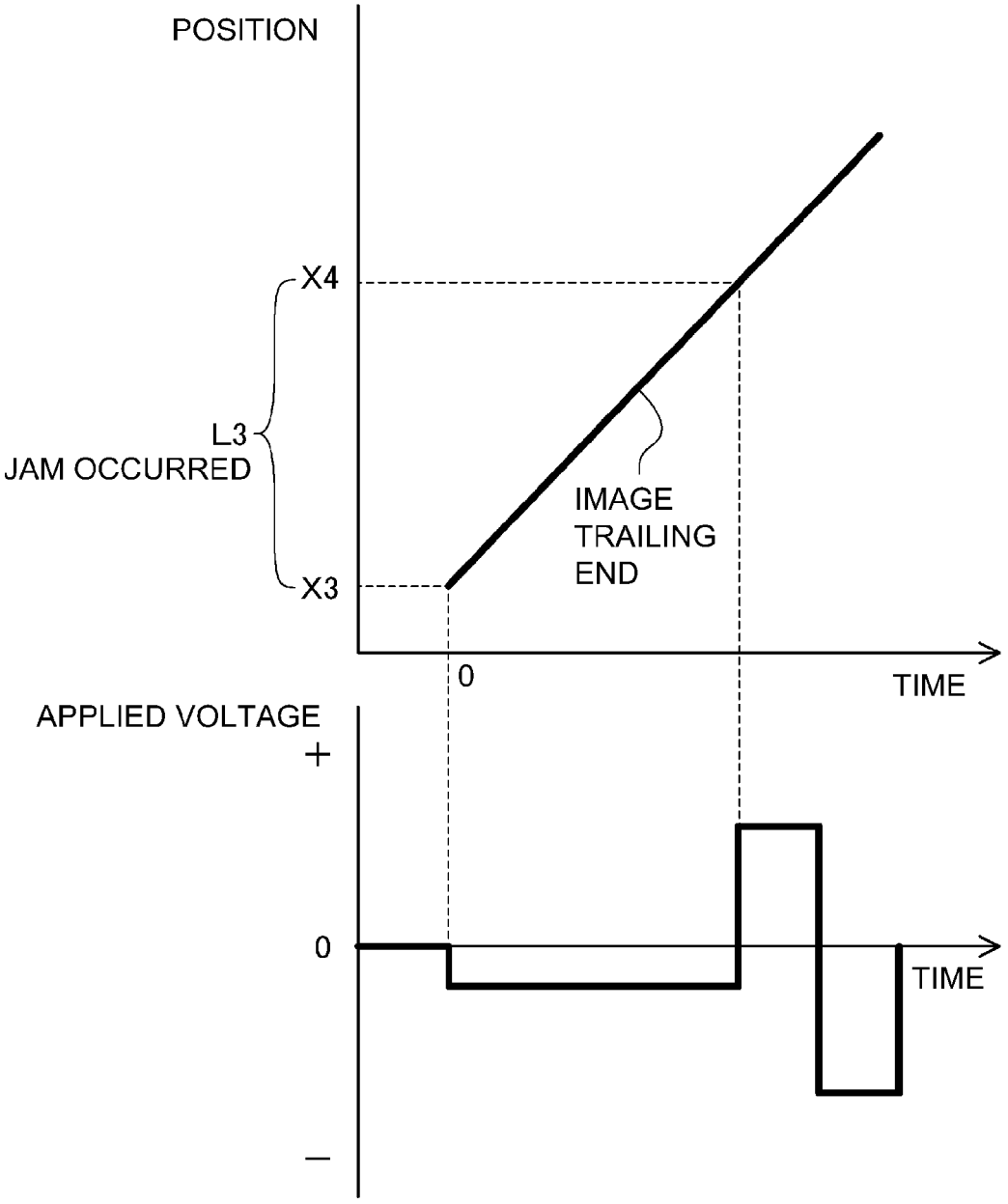
FIG. 6 is a time chart of control in a restoring pattern A.
Figure 7:
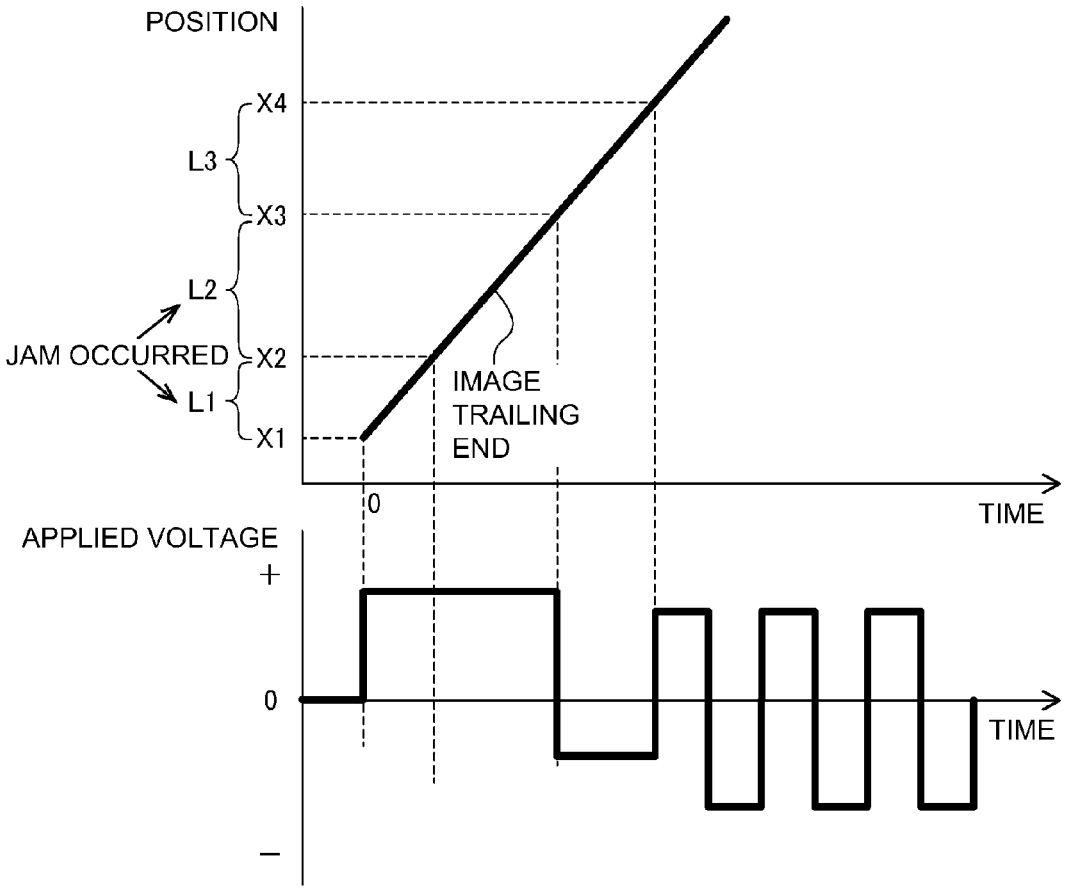
FIG. 7 is a time chart of control in a restoring pattern B.

FIG. 4 is a flowchart of an operation in a collecting mode executed after the jam clearance. FIG. 5 is an illustration of collecting mode switching control depending on a stop position of the toner image. FIG. 6 is a time chart of control in a restoring pattern A. FIG. 7 is a time chart of control in a restoring pattern B. In this embodiment, the operation in the collecting mode of the image forming apparatus during restoring from the jam during the full-color image formation is described.

As shown in FIG. 1, the controller 301 as an example of the control means is capable of executing the operation in the collecting mode when the apparatus main assembly is stopped after the occurrence of the jam of the recording material and then is restored to a normal state. In the operation in the collecting mode, the toner image carried on the photosensitive drum 2K when the apparatus main assembly is stopped is transferred onto the intermediary transfer belt 7 and then is collected by the belt cleaning device 15. Further, other toner images formed at the image forming portions 1Y, 1M and 1C are passed through the primary transfer position of the photosensitive drum 2 and then are collected by the belt cleaning device 15.

In the operation in the collecting mode, the secondary transfer high voltage source 307 transfers, onto the intermediary transfer belt 7, the toner in an upstream end region of the toner image, with respect to the rotational direction of the image bearing member, carried on the photosensitive drum 2 by applying the voltage of the opposite polarity to the toner charge polarity to the secondary transfer roller 11.

In the operation in the collecting mode, the voltage of the identical voltage to the toner charge polarity is continuously applied to the secondary transfer roller 11 until an upstream end region of other toner images on the intermediary transfer belt 7 passes through at least the secondary transfer position after passing through the primary transfer position. In the operation in the collecting mode, the voltage of the opposite polarity to the toner charge polarity is applied to the secondary transfer roller 11 through at least one full turn of the secondary transfer roller 11 after the upstream end region of other toner images on the intermediary transfer belt 7 is passed through the secondary transfer position.

As shown in FIG. 4 with reference to FIG. 1, when the image forming operation is started (S1), the controller 301 causes the recording material P to be taken out from the recording material cassette 25 and then to be fed to the registration roller pair 17. In the case where the top sensor 302 does not detect that the recording material P reaches the registration roller pair 17, the controller 301 discriminates that the jam of the recording material P occurs at a position from the recording material cassette 25 to the registration roller pair 17 (YES of S2). In this case, the controller 301 stops the image forming operation and at the same time notifies a user of the jam occurrence by displaying the jam occurrence at a display portion 308 (S3).

In the case where the jam does not occur (NO of S2), the controller 301 continues the image forming operation at the image forming portions 1Y, 1M, 1C and 1K. In the case where the secondary transfer and fixing of the toner image and the discharge of the recording material P are properly performed, the passing of the recording material P is detected at predetermined timing by the discharge sensor 303. However, in the case where the passing of the recording material P is not detected by the discharge sensor 303 even after a lapse of a predetermined time, the controller 301 discriminates that the jam of the recording material P occurs at a position from the fixing device to the discharging roller pair 28 (YES of S2). Also in this case, the controller 301 stops the image forming operation and at the same time notifies the user of the jam occurrence by displaying the jam occurrence at the display portion 308 (S3).

In the case where the controller 301 discriminates that the jam occurs, the controller 301 instantaneously stops the image forming operation and also immediately stops the secondary transfer high voltage source 307, the charging high voltage source 304, the developing high voltage source 305 and the auxiliary charging member high voltage source 306 (S3).

When the jam clearance is made and completed by the user (S4), the controller 301 starts the operation in which the toner images remaining on the photosensitive drums 2Y, 2M, 2C and 2K and the intermediary transfer belt 7 are collected by the belt cleaning device 15.

The controller 301 identifies positions of the toner images, in a rest state after the jam contact, from information as to whether the image forming operation is ended after seconds from start of the image formation and information as to whether or not an image forming job during execution is continuous image formation (S6). The controller 301 identifies the positions of a trailing end of the toner image on each of the photosensitive drums 2Y, 2M, 2C and 2K or on the intermediary transfer belt 7 (S6).

The controller 301 changes control of the secondary transfer high voltage source 307 during the restoring from the jam to the normal state depending on whether the position of the trailing end of the toner image is upstream or downstream of the primary transfer portion T1 of the image forming portion 1K. The controller 301 discriminates which pattern of the restoring pattern A and the restoring pattern B should be performed (S7).

As shown in FIG. 5, in the case where the trailing end position of the toner image is downstream of a primary transfer portion X3 (NO of S7), the controller 301 executes the control in the restoring pattern A shown in FIG. 6 (S8). However, in the case where the trailing end position of the toner image is upstream of the primary transfer portion X3 (YES of S7), the controller 301 executes the control in the restoring pattern B shown in FIG. 7 (S9).

As shown in FIG. 6, in the restoring pattern A, there is no toner image on the photosensitive drums 2Y, 2M, 2C and 2K, and therefore only the toner image remaining in a section L3 on the intermediary transfer belt 7 shown in FIG. 5 is collected by the belt cleaning device 15. In the restoring pattern A, the toner image on the intermediary transfer belt 7 is made less transferable by applying the negative DC voltage to the secondary transfer roller 11 until the intermediary transfer belt 7 is rotationally driven and the toner image passes through the secondary transfer portion T2. In this embodiment, the negative DC voltage is −300 V. As a result, a degree of contamination of the secondary transfer member 11 is minimized during the passing of the toner image on the intermediary transfer belt 7 through the secondary transfer portion T2.

Thereafter, when the passing of the toner image through the secondary transfer portion T2 is ended, "the toner charged to the opposite polarity to the normal polarity" deposited on the secondary transfer roller 11 is transferred onto the intermediary transfer belt 7 by applying the positive DC voltage through first one full circumference of the secondary transfer roller 11. As the positive DC voltage, the same voltage as the DC voltage applied to the secondary transfer roller 11 in the last image forming operation is applied. There is a possibility that the toner charged to the opposite polarity to the normal polarity due to electric discharge or the like is deposited during the image formation or until the toner image passes through the secondary transfer portion T2, and therefore control is effected so that the toner charged to the opposite polarity to the normal polarity is transferred onto the intermediary transfer belt 7.

Then, through subsequent one full circumference of the secondary transfer roller 11, by applying the negative DC voltage, "the toner charged to the normal polarity" deposited on the secondary transfer roller 11 is transferred onto the intermediary transfer belt 7.

As the negative DC voltage, a voltage of −300 V is uniformly applied. There is a possibility that the toner charged to the normal polarity is deposited during the image formation or until the toner image passes through the secondary transfer portion T2, and therefore control is effected so that the toner charged to the normal polarity is transferred onto the intermediary transfer belt 7. Thereafter, the controller 101 resumes the image forming operation (starting from S2) at the timing when the trailing end of the toner image is collected by the belt cleaning device 15.

As shown in FIG. 7, in the restoring pattern B, there is the trailing end of the toner image in a section L1 or L2 in FIG. 5, and therefore there is a need to transfer the toner images from the photosensitive drums 2Y, 2M, 2C and 2K onto the intermediary transfer belt 7. In the restoring pattern B, the toner images on the photosensitive drums 2Y, 2M, 2C and 2K are transferred onto the intermediary transfer belt 7 by applying the positive DC voltage to the secondary transfer roller 11 until the drive of the intermediary transfer belt 7 is started and the toner image trailing end passes through the primary transfer portion X3. In this case, the toner in a considerable amount is transferred from the toner image passing through the secondary transfer portion T2 onto the secondary transfer roller 11, so that the secondary transfer roller is contaminated. Therefore, the toner images on the photosensitive drums 2Y, 2M, 2C and 2K have already been transferred onto the intermediary transfer belt 7, and therefore the transfer of the toner from the intermediary transfer belt 7 is prevented by applying the negative DC voltage to the secondary transfer roller 11.

Thereafter, when the toner image trailing end passes through a secondary transfer portion X4, every one full turn the secondary transfer roller 11, the positive and negative DC voltages are applied to the secondary transfer roller 11 in a switching manner. As the positive DC voltage, the same voltage as the DC voltage applied to the secondary transfer roller 11 in the last image forming operation is applied. As the negative DC voltage, the voltage of −300 V is uniformly applied.

During the application of the positive DC voltage, the toner charged to the opposite polarity to the normal charge polarity is transferred from the secondary transfer roller 11 onto the intermediary transfer belt 7. During the application of the negative DC voltage, the toner charged to the normal polarity is transferred from the secondary transfer roller 11 onto the intermediary transfer belt 7. By repeating this operation three times, the toner deposited on the secondary transfer roller 11 is sufficiently cleaned. The controller 101 resumes the image forming operation (starting from S2) at the timing when the trailing end of the toner image is collected by the belt cleaning device 15. In the case where the jam occurrence is not detected and then the image formation is ended (YES of S11), the image forming operation is ended and then the operation of the main assembly is stopped (S10).

Effects of Embodiment 1

The image forming apparatus 100 does not include the transfer roller at the primary transfer portion T1, so that there is no local increase in transfer pressure generated by pressing the intermediary transfer belt 7 against the photosensitive drum 2K by the transfer roller. For that reason, compared with a conventional transfer roller type, toner agglomeration resulting from the local increase in transfer pressure is not readily generated, so that a hollow image phenomenon resulting from the toner agglomeration at an end portion of thin-line toner image is not readily generated. The image forming apparatus 100 does not include a cleaning blade for removing the transfer residual toner on the photosensitive drum, and therefore there is no room in which a frictional resistance of the cleaning blade fluctuates, so that a rotational speed of the photosensitive drum is stabilized and also power consumption for the drive may be small.

The image forming apparatus 100 employs a constitution in which a dedicated primary transfer high voltage source is not provided and in addition, the transfer roller is omitted at the primary transfer portion T1, and therefore downsizing and cost reduction of an exchanging unit and the image forming apparatus which include the intermediary transfer belt are realized. The image forming apparatus 100 employs a low-cost constitution also at portions other than the primary transfer portion T1, so that a product reduced in cost as a whole is realized.

According to Embodiment 1, in the image forming apparatus 100, during re-actuation (restart) after the jam clearance, it is possible to collect, by the belt cleaning device 15, all the toner remaining on the photosensitive drums and the intermediary transfer belt. Until the toner image trailing end passes through the primary transfer portion T1, the potential of the intermediary transfer belt 7 is made positive by applying the positive voltage to the secondary transfer roller 11, and therefore untransferred toner images on the photosensitive drums can be transferred onto the intermediary transfer belt. Thereafter, during movement of the toner image trailing end between the primary transfer portion T1 and the secondary transfer portion T2, the potential of the intermediary transfer belt 7 is made negative by applying the negative voltage to the secondary transfer roller 11, and therefore it is possible to suppress the toner deposition on the secondary transfer roller 11. Finally, both the negatively and positively charged toners deposited on the secondary transfer roller 11 are transferred onto the intermediary transfer belt and then are collected by the belt cleaning device 15. In this way, in the image forming apparatus of the simultaneous development and cleaning type in which the primary transfer high voltage source is not provided, during the re-actuation after the jam clearance, it becomes possible to collect all the toners remaining on the photosensitive drums and the intermediary transfer belt. In a constitution in which during the re-actuation after the jam clearance, the positive voltage cannot be applied to the primary transfer portion while the negative voltage is applied to the secondary transfer portion, the transfer residual toners on the photosensitive drums and the intermediary transfer belt can be collected by the belt cleaning device without generating the back surface contamination of the recording material.

According to Embodiment 1, it is possible to reduce a load generated by entrance of the toner in a large amount at once into the image forming portions (photosensitive drums) having the cleaner-less constitution.

Incidentally, in this embodiment, stop of the operation due to the jam occurrence during the image formation is assumed, but also in the case of emergency stop by an opening operation of the main assembly cover during the image formation, the sequence in the collecting mode in this embodiment is executed. Accordingly, also in the case where the image forming operation is interrupted by the reason other than the jam clearance, the present invention is carried out.

Embodiment 2

Figure 8:
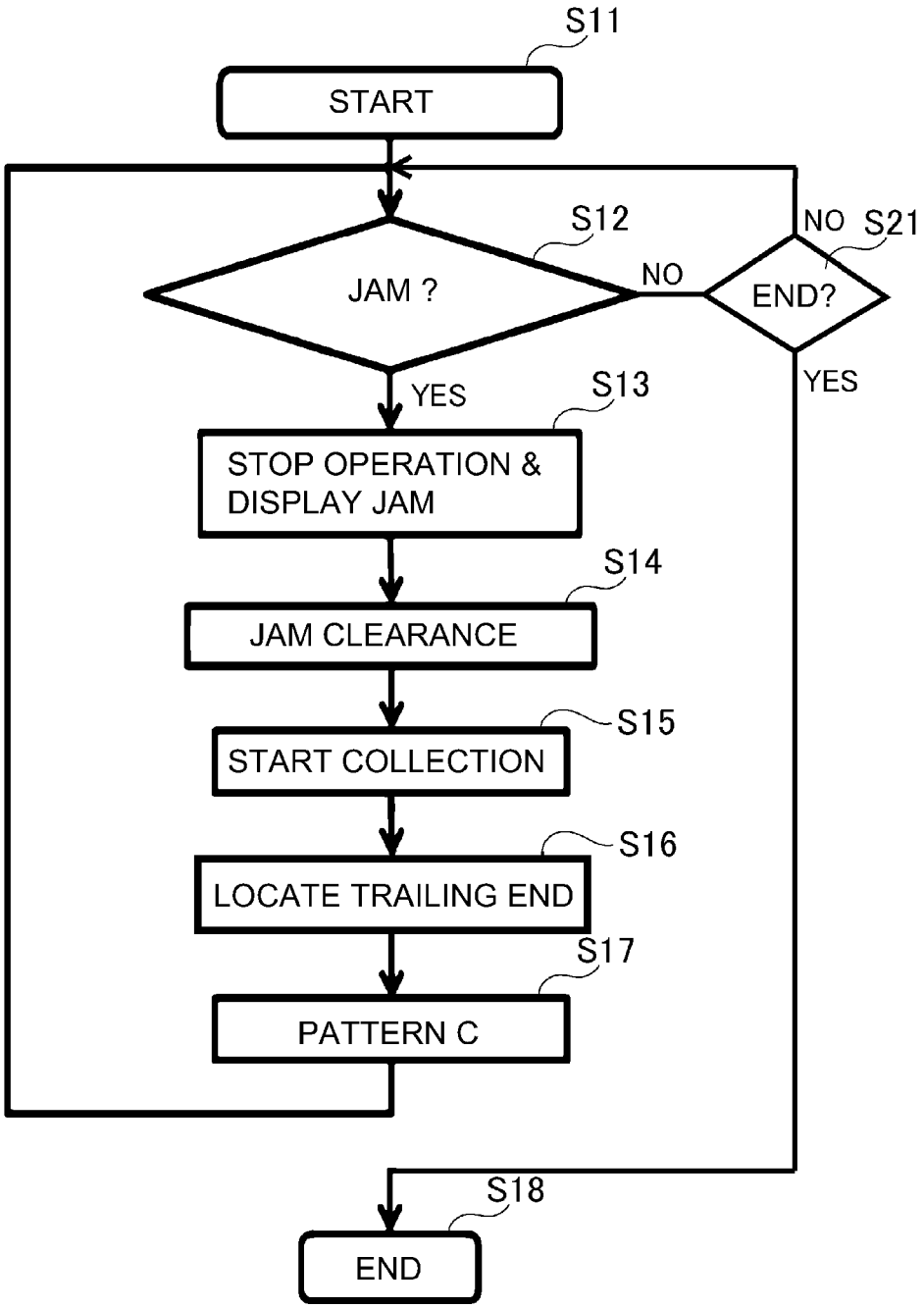
FIG. 8 is a flowchart of control of an operation in a collecting mode in Embodiment 2.
Figure 9:
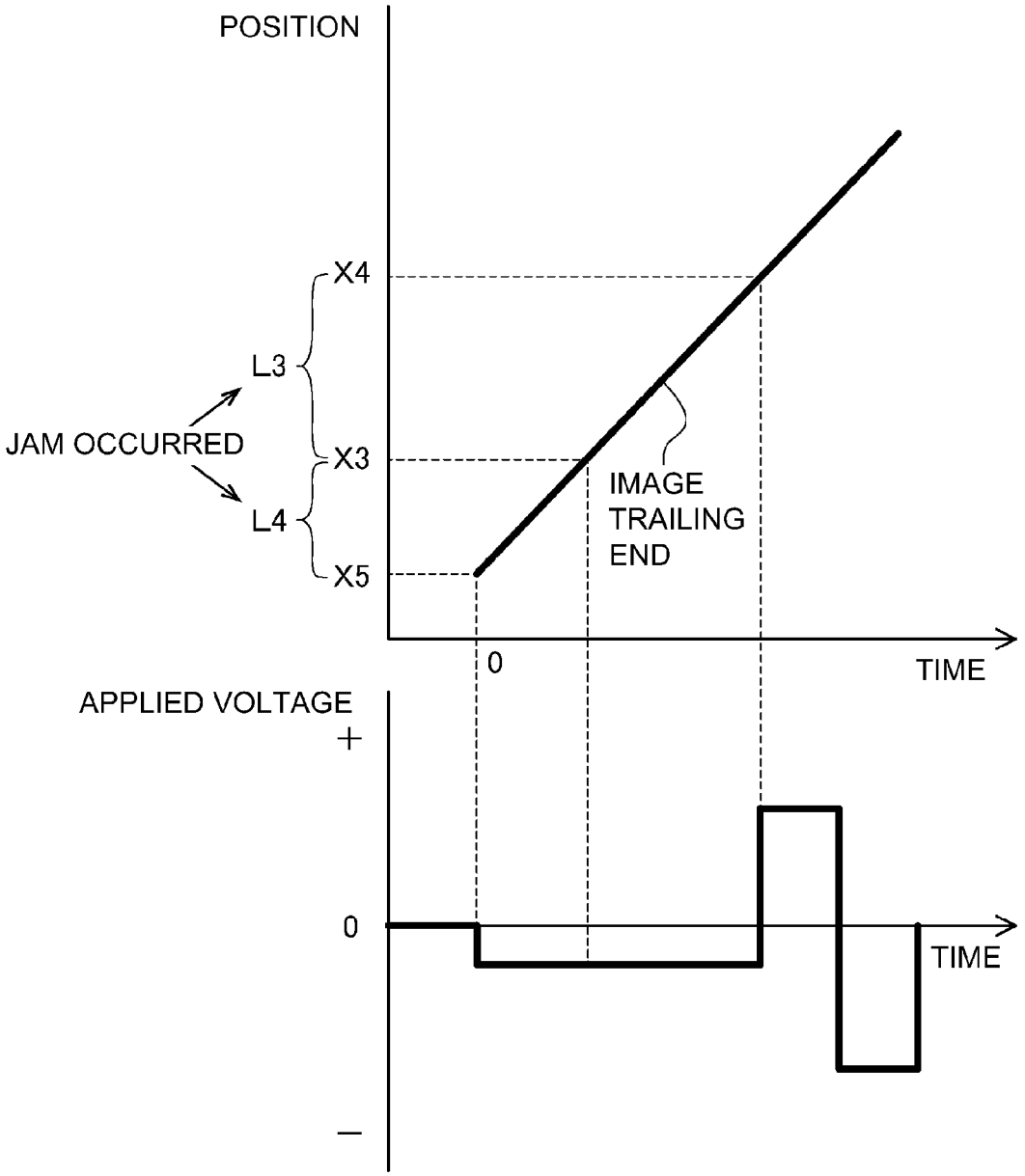
FIG. 9 is a time chart of control in a restoring pattern C.

FIG. 8 is a flowchart of control of an operation in a collecting mode in this embodiment. FIG. 9 is a time chart of control in a restoring pattern C. In this embodiment, the operation in the collecting mode of an image forming apparatus during restoring from a jam to a normal state during black (monochromatic) image formation will be described.

As shown in FIG. 1, the controller 301 is capable of selectively executing an operation in a full-cover mode as an example of a first image forming mode and an operation in a black (monochromatic) mode as an example of a second image forming mode. In the operation in the full-color mode, in the case where the toner image is formed on the photosensitive drum 2K, the image forming portions 1Y, 1M and 1C are kept in an operating state. In the operation in the black mode, the image forming portions 1Y, 1M and 1C are kept in a non-operating state.

In the operation in the collecting mode (during the second image forming mode), the toner image carried on the photosensitive drum 2 is passed through the primary transfer position and is collected by the developing device 5K, without being transferred onto the intermediary transfer belt 7, by applying the voltage of the identical polarity to the toner charge polarity to the secondary transfer roller 11.

The voltage of the opposite polarity to the toner charge polarity is applied to the secondary transfer roller 11 through at least one full turn of the secondary transfer roller 11 after the upstream end region of other toner images on the photosensitive drum 2K is passed through the secondary transfer position.

As shown in FIG. 8 with reference to FIG. 1, when the image forming operation is started (S11), the controller 301 causes the recording material P to be taken out from the recording material cassette 25 and then to be fed to the registration roller pair 17. In the case where the top sensor 302 does not detect that the recording material P reaches the registration roller pair 17, the controller 301 discriminates that the jam of the recording material P occurs at a position from the recording material cassette 25 to the registration roller pair 17 (YES of S12). In this case, the controller 301 stops the image forming operation and at the same time notifies a user of the jam occurrence by displaying the jam occurrence at a display portion 308 (S13).

In the case where the jam does not occur (NO of S12), the controller 301 continues the image forming operation at the image forming portion 1K. In the case where the secondary transfer and fixing of the toner image and the discharge of the recording material P are properly performed, the passing of the recording material P is detected at predetermined timing by the discharge sensor 303. However, in the case where the passing of the recording material P is not detected by the discharge sensor 303 even after a lapse of a predetermined time, the controller 301 discriminates that the jam of the recording material P occurs at a position from the fixing device to the discharging roller pair 28 (YES of S12). Also in this case, the controller 301 stops the image forming operation and at the same time notifies the user of the jam occurrence by displaying the jam occurrence at the display portion 308 (S13).

In the case where the controller 301 discriminates that the jam occurs, the controller 301 instantaneously stops the image forming operation and also immediately stops the secondary transfer high voltage source 307, the charging high voltage source 304, the developing high voltage source 305 and the auxiliary charging member high voltage source 306 (S13).

When the jam clearance is made and completed by the user (S14), the controller 301 starts the operation in which the toner images remaining on the photosensitive drum 2K and the intermediary transfer belt (intermediary transfer member) 7 are collected by the belt cleaning device 15.

Different from Embodiment 1, the controller 301 executes control of the secondary transfer high voltage source 307 during the restoring from the jam to the normal state in accordance with the restoring pattern C even when the position of the trailing end of the toner image is not only upstream but also downstream of the primary transfer portion T1 of the image forming portion 1K (S17).

As shown in FIG. 9 with reference to FIG. 5, in the restoring pattern C, the toner image trailing end during the re-actuation is present in a section L3 or a section L4. The controller 301 prevents the transfer of the toner image from the intermediary transfer belt 7 onto the secondary transfer roller 11 by applying the negative voltage to the secondary transfer roller 11 until rotation of the intermediary transfer belt 7 is started and the toner image trailing end passes through the secondary transfer portion T2.

Thereafter, when the toner image trailing end passed through the secondary transfer portion T2, the controller 301 causes the toner, charged to the positive polarity, deposited on the secondary transfer roller 11 to be transferred onto the intermediary transfer belt 7 by applying, to the secondary transfer roller 11, the positive DC voltage through first one turn of the secondary transfer roller 11. Then, through subsequent one full turn of the secondary transfer roller 11, by applying the negative DC voltage to the secondary transfer roller 11, the toner charged to the negative polarity deposited on the secondary transfer roller 11 is transferred onto the intermediary transfer belt 7. That is, the restoring pattern A in Embodiment 1 shown in FIG. 6 is uniformly applied. Also in the restoring pattern C, the positive voltage is the same as the voltage applied to the secondary transfer roller 11 in the last image forming operation, and the negative voltage is −300 V.

Thereafter, the toner image transferred on the intermediary transfer belt 7 and the toner transferred from the secondary transfer roller 11 are collected by the belt cleaning device 15. After a lapse of predetermined seconds from reaching timing, the controller 301 resumes the image forming operation (S17). In the case where the jam occurrence is not detected and then the image formation is ended (YES of S21), the image forming operation is ended and then the operation of the main assembly is stopped (S18).

In the restoring pattern C, the (untransferred) toner image on the photosensitive drum (image bearing member) 2K is sent to the toner re-charging device 6K without being transferred onto the intermediary transfer belt 7, and then is charged by the upstream auxiliary charging member 203 and the downstream auxiliary charging member 204. In the case of the black (monochromatic) image formation, the toner reaching the upstream auxiliary charging member 203 is only the toner deposited on the photosensitive drum 2K in the section L4 and the amount thereof is small, and therefore the upstream auxiliary charging member 203 is not clogged with the toner. Further, the black image forming portion 1K is located downstreammost of the image forming portions 1Y, 1M, 1C and 1K, and therefore there is no possibility of an occurrence of color mixing caused by collection of different color toners by the developing device 5K. Accordingly, in the restoring pattern C, the toner on the photosensitive drum 2K is not necessarily required to be transferred onto the intermediary transfer belt 7.

According to Embodiment 2, during the re-actuation after the clearance in the case where the jam occurs during the black (monochromatic) image formation, both the toner on the photosensitive drum 2K and the toner on the intermediary transfer belt 7 can be collected while cleaning the secondary transfer roller 11. The toner remaining on the intermediary transfer belt 7 is collected in the belt cleaning device 15, and the toner remaining on the photosensitive drum 2K is collected by the developing device 5K. As a result, in the image forming apparatus of the simultaneous development and cleaning type including no primary transfer high voltage source, during the re-actuation after the jam clearance, the transfer residual toners on the photosensitive drum and the intermediary transfer belt can be collected without generating the back surface contamination of the recording material.

Embodiment 3

Figure 10:
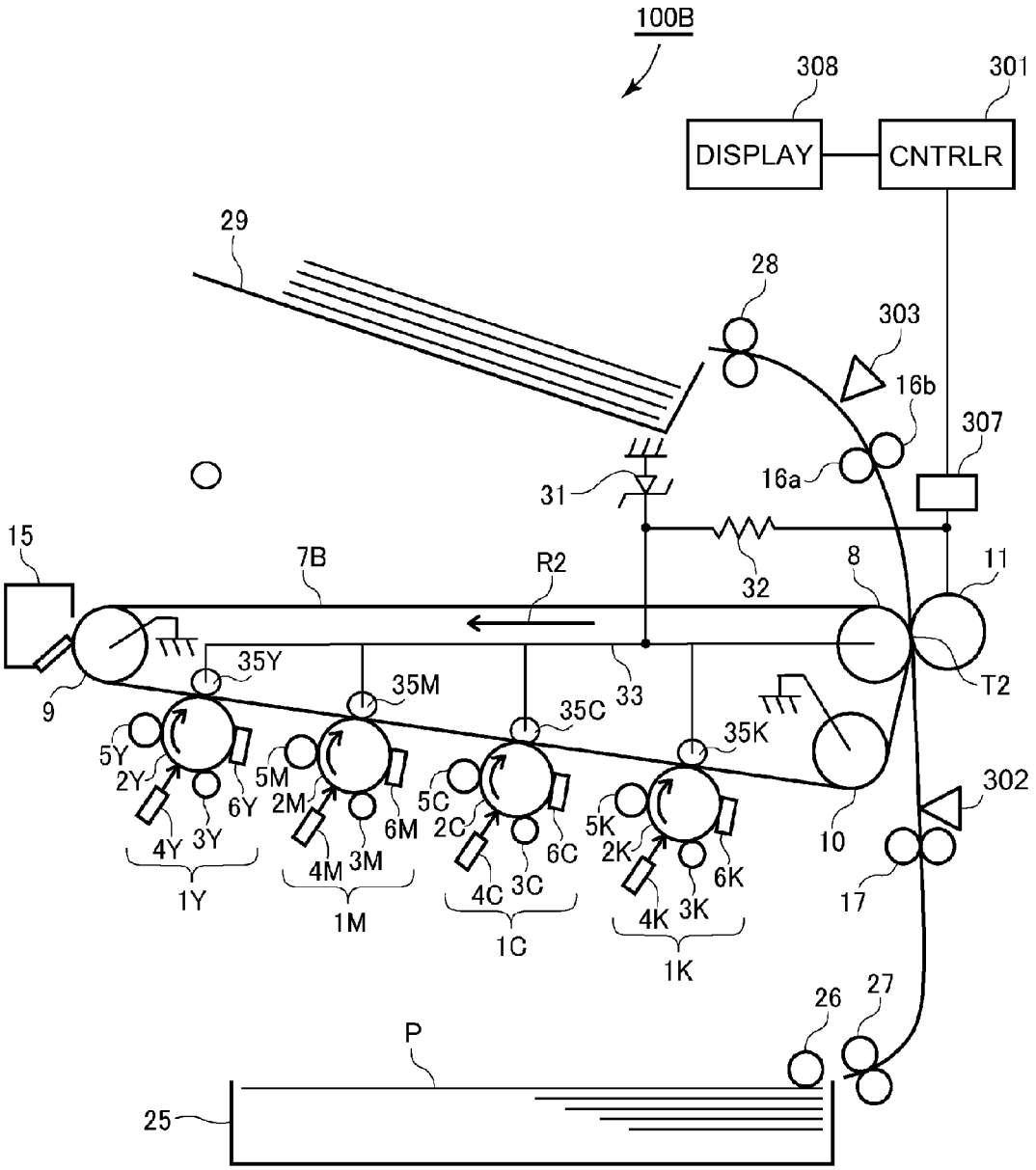
FIG. 10 is an illustration of a structure of an image forming apparatus in Embodiment 3.

FIG. 10 is an illustration of a structure of an image forming apparatus in this embodiment. As shown in FIG. 10, a primary transfer roller 35K as an example of the transfer roller sandwiches the intermediary transfer belt 7 between itself and the photosensitive drum 2K and forms a primary transfer electric field at a primary transfer position. The secondary transfer inner roller 8 as an example of an electroconductive opposite roller is disposed at an opposing position to the secondary transfer roller 11 via an intermediary transfer belt 7B. The Zener diode 31 is electrically connected to the secondary transfer inner roller 8.

An image forming apparatus 100B does not include the electroconductive layer (base layer 7*a* in FIG. 2) in the intermediary transfer belt 7B, and therefore at the primary transfer portion T1, the toner image is transferred from the photosensitive drum 35K onto the intermediary transfer belt 7B by using the primary transfer roller 35K. The secondary transfer high voltage source 307 and the Zener diode 31 simultaneously apply voltages of the same polarity to the secondary transfer roller 11 and the primary transfer roller 35K.

As shown in FIG. 10, in the image forming apparatus 100B, primary transfer rollers 35Y, 35M, 35C and 35K are contacted to the intermediary transfer belt 7B including no low-resistance base layer 7*a* (FIG. 2), and the voltage is applied to the primary transfer portion T1. The primary transfer rollers 35Y, 35M, 35C and 35K of the image forming apparatus 100B sandwich the intermediary transfer belt 7B between each of the rollers and an associated one of the photosensitive drums 2Y, 2M, 2C and 2K to form an associated primary transfer portion T1. The secondary transfer inner roller 8 and the primary transfer rollers 35Y, 35M, 35C and 35K are electrically connected by the circuit wiring 33, and to the circuit wiring 33, the Zener diode 31 is connected. The intermediary transfer belt 7B is $1\times10^9$ Ω·cm in volume resistivity, and therefore even when the tension roller 9 and the driving roller 10 are connected to the ground potential, the voltage applied to the primary transfer portion T1 is not leaked out.

The resistance 32 lowers an output voltage of a secondary transfer high voltage source 307 and transmits the voltage (potential) to the circuit wiring 33, so that the potential of the secondary transfer high voltage source 307 is kept at Zener potential of the Zener diode 31. Incidentally, the current flows through the secondary transfer portion T2, and therefore the resistance 32 can be omitted.

In this embodiment, in the image forming apparatus 100B constituted as described above, when the jam occurs during the full-color image formation, the control of the operation in the collecting mode shown in FIG. 4 is executed. Further, when the jam occurs during the black (monochromatic) image formation, the control of the operation in the collecting mode shown in FIG. 8 is executed.

Embodiment 4

The present invention can also be carried out in other embodiments, in which a part or all of constituent elements of the structure of the embodiment shown in FIG. 1 or FIG. 10 are replaced with their alternative constituent elements, so long as the toner is transferred onto the intermediary transfer belt by applying the voltages of the positive and negative polarities to the transfer member during the reactuation after the jam clearance.

The present invention can be carried out also in an embodiment in which an intermediary transfer roller as another example of the intermediary transfer member is used. The intermediary transfer roller includes a columnar or cylindrical drum core metal, and the drum core metal keeps a potential at a constant level with respect to a circumferential direction of the intermediary transfer roller. The potential is generated on the drum core metal by connecting the Zener diode 31 to the drum core metal as shown in FIG. 10, and then a voltage to be applied to the secondary transfer portion and a voltage at the primary transfer portion are set. The secondary transfer high voltage source 307 applies the voltage of the same polarity simultaneously to the secondary transfer roller and the intermediary transfer roller of which potential is kept at the constant level by the Zener diode 31.

The present invention is not limited to the case where the operation is stopped due to the jam occurrence during the image formation, but can also be carried out in the case where the image forming operation is interrupted due to the reason other than the jam occurrence, such as the case where the main assembly cover is opened during the image formation and thus the image forming operation is stopped due to an emergency.

The present invention can be carried out is in not only the image forming apparatus of the two-component development type but also an image forming apparatus of a one-component development type. The present invention can be carried out in any of image forming apparatuses of a tandem type and a one-drum type so long as the image forming apparatus is provided with the intermediary transfer belt. The image bearing member is not limited to the organic photosensitive member but may also be an inorganic photosensitive member such as an amorphous silicon photosensitive member. The image bearing member is not limited to the drum-like image bearing member but may also be a belt-like image bearing member. Also with respect to the charging type, the developing type, the transfer type, the belt cleaning type and the fixing type, any type thereof is selectable. In the above-described embodiments, only the principal part of the toner image formation and transfer was described, but the present invention can be carried out in image forming apparatuses in various fields, such as printers, various printing machines, copying machines, facsimile machines, and multi-function machines, by adding necessary devices, equipment and casing structures.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 075760/2013 filed Apr. 1, 2013, which is hereby incorporated by reference.

What is claimed is:

1. An image forming apparatus comprising:

a plurality of image forming units, each including a photosensitive member, an electrostatic image forming unit, and a developing device, the electrostatic image forming unit being configured to form an electrostatic image on said photosensitive member, the developing device being configured to develop the electrostatic image into a toner image and capable of collecting transfer residual toner deposited on said photosensitive member;

an intermediary transfer member configured to carry the toner image primary transferred from at least one of said photosensitive members at each of primary transfer portions, each of the primary transfer portions being provided at a position opposing a corresponding photosensitive member and including a most downstream primary transfer portion and a most upstream primary transfer portion with respect to a rotational direction of said intermediary transfer member;

a rotatable transfer member configured to secondary transfer the toner image from said intermediary transfer member onto a recording material while sandwiching the recording material between said rotatable transfer member and said intermediary transfer member at a secondary transfer portion;

a constant voltage element, electrically connected between said intermediary transfer member and a ground potential, configured to maintain a predetermined voltage by flow of a current therethrough;

a power source configured to form a secondary transfer electric field at the secondary transfer portion by applying a voltage to said rotatable transfer member and configured to form a primary transfer electric field at the primary transfer portion by passing the current through said constant voltage element;

a cleaning device configured to remove toner deposited on said intermediary transfer member at a side downstream of the secondary transfer portion and upstream of the primary transfer portion with respect to the rotational direction of said intermediary transfer member; and a controller configured to execute, during interruption of an image forming operation due to occurrence of a jam of the recording material, an operation in a collecting mode in which said photosensitive members and said intermediary transfer member are rotationally driven under application of a predetermined voltage to said rotatable transfer member, and collect untransferred toner, by said cleaning device, carried on said photosensitive members and said intermediary transfer member without being subjected to a secondary transfer process at the secondary transfer portion, wherein when the untransferred toner is carried on said intermediary transfer member at a side upstream of the most downstream primary transfer portion and downstream of the most upstream primary transfer portion with respect to the rotational direction of said intermediary transfer member, said controller executes the following operations during execution of the operation in the collecting mode:

(i) during passing of the untransferred toner through each of the primary transfer portions during the execution of the operation in the collecting mode, said controller effects control so that a voltage of an opposite polarity to a charge polarity of the toner is applied to said rotatable transfer member, and (ii) after passing of the untransferred toner through each of the primary transfer portions during the execution of the operation in the collecting mode, said controller effects control so that a voltage of an identical polarity to the charge polarity of the toner is applied to said rotatable transfer member.

2. An image forming apparatus comprising:

a plurality of image forming units, each including a photosensitive member, an electrostatic image forming unit, and a developing device, the electrostatic image forming unit being configured to form an electrostatic image on said photosensitive member, the developing device being configured to develop the electrostatic image into a toner image and capable of collecting transfer residual toner deposited on said photosensitive member;

an intermediary transfer member configured to carry the toner image primary-transferred from at least one of said photosensitive members at a primary transfer portion;

a rotatable transfer member configured to secondary-transfer the toner image from said intermediary transfer member onto a recording material while sandwiching the recording material between said rotatable transfer member and said intermediary transfer member at a secondary transfer portion;

a constant-voltage element, electrically connected between said intermediary transfer member and a ground potential, configured to maintain a predetermined voltage by flow of current therethrough;

a power source configured to form a secondary transfer electric field at the secondary transfer portion by applying a voltage to said rotatable transfer member and configured to form a primary transfer electric field at the primary transfer portion by passing the current through said constant-voltage element;

a cleaning device configured to remove toner deposited on said intermediary transfer member at a side downstream of the secondary transfer portion and upstream of the primary transfer portion with respect to a rotational direction of said intermediary transfer member;

a controller configured to execute, when a main assembly of said image forming apparatus, in which a jam of the recording material occurs, is stopped and then is restored to a normal state, an operation in a collecting mode in which said photosensitive members and said intermediary transfer member are rotationally driven under application of a predetermined voltage to said rotatable transfer member, and a first toner image carried on at least one of said photosensitive members and a second toner image carried on said intermediary transfer member when the main assembly is stopped are collected by said cleaning device, wherein said controller is configured to apply a voltage of a first polarity to said rotatable transfer member in a first period starting from the collecting mode and to apply a voltage of an opposite polarity to the first polarity to said rotatable transfer member in a second period subsequent to the first period depending on a position of the first toner image and a position of the second toner image after the jam in the operation in the collecting mode, and wherein said controller controls said power source in the operation in the collecting mode so that when the first toner image is in a region upstream of the primary transfer portion and downstream of the developing device on at least one photosensitive member after the jam or when the second toner image is in a region upstream of a most downstream primary transfer portion and downstream of a most upstream primary transfer portion on said intermediary transfer member after the jam, a voltage of an opposite polarity to a charge polarity of the toner is applied to said rotatable transfer member in the first period from start of the operation in the collecting mode until the first toner image and the second toner image pass through the most downstream primary transfer portion, and a voltage of an identical polarity to the charge polarity of the toner is applied to said rotatable transfer member in the second period subsequent to the first period.

3. The image forming apparatus according to claim 1, wherein during the execution of the operation in the collecting mode, after passing of the untransferred toner through the most downstream primary transfer portion and before passing of the untransferred toner through the secondary transfer portion, said controller effects control so that the voltage of the polarity identical to the charge polarity of the toner is applied to said rotatable transfer member.

4. The image forming apparatus according to claim 2, wherein the second period is a time not less than a time required for one turn of said rotatable transfer member.

5. The image forming apparatus according to claim 1, wherein said intermediary transfer member is an intermediary transfer belt including an electroconductive layer on an inside thereof and a layer, on an outside thereof, having a volume resistivity higher than the electroconductive layer, wherein said constant-voltage element is electrically connected to the inside of said intermediary transfer belt.

6. The image forming apparatus according to claim 1, wherein said rotatable transfer member is a roller.

7. The image forming apparatus according to claim 1, further comprising a primary transfer roller at each primary transfer portion.

8. The image forming apparatus according to claim 1, wherein during the operation in the collecting mode, said controller effects control so that after the untransferred toner passes through the secondary transfer portion, a bias of an identical polarity to a normal charge polarity of the toner and a bias of an opposite polarity to the normal charge polarity of the toner are alternately applied a predetermined number of times to said rotatable transfer member, and wherein said controller changes the predetermined number of times depending on a position of the untransferred toner during the occurrence of the jam.

9. An image forming apparatus comprising:

a plurality of image forming units configured to form toner images, each of said image forming units including an image bearing member on which the toner images are to be formed and a developing device configured to develop electrostatic images into the toner images on said image bearing member and configured to collect transfer residual toner deposited on said image bearing member;

an intermediary transfer member configured to receive the toner images primary transferred from said image bearing members at each of primary transfer portions opposing said image bearing members;

a secondary transfer member configured to secondary transfer the toner images from said intermediary transfer member onto a recording material while sandwiching the recording material between said secondary transfer member and said intermediary transfer member at a secondary transfer portion, wherein the primary transfer portions include a most downstream primary transfer portion at a side upstream of the secondary transfer portion with respect to a rotational direction of said intermediary transfer member, and include a most upstream primary transfer portion at a side downstream of the secondary transfer portion with respect to the rotational direction of said intermediary transfer member;

a common power source configured to form a primary transfer electric field at the primary transfer portions and a secondary transfer electric field at the secondary transfer portion by applying a voltage to said secondary transfer member;

a cleaning device configured to remove toner deposited on said intermediary transfer member; and a controller configured to execute an operation in a collecting mode in which when a jam of the recording material occurs, remaining toners remaining on said image bearing members or said intermediary transfer member without being transferred onto the recording material are collected by said cleaning device, wherein during execution of the operation in the collecting mode, throughout a period in which the remaining toners on said image bearing members or said intermediary transfer member pass through the primary transfer portions, said controller effects control so that a voltage of an opposite polarity to a charge polarity of the toner is applied to said secondary transfer member, and wherein during the execution of the operation in the collecting mode, after an upstream side end region, with respect to the rotational direction of said intermediary transfer member, of the remaining toners passes through the most downstream primary transfer portion, said controller effects control so that a voltage of an identical polarity to a charge polarity of the toner is applied to said secondary transfer member.

10. The image forming apparatus according to claim 9, further comprising a constant voltage element, electrically connected between said intermediary transfer member and a ground potential, configured to maintain a potential of said intermediary transfer member at a predetermined voltage by flow of a current therethrough.

11. The image forming apparatus according to claim 9, wherein during the execution of the operation in the collecting mode, before the upstream side end region, with respect to the rotational direction of said intermediary transfer member, of the remaining toners passes through the secondary transfer portion, said controller effects control so that the voltage of the identical polarity to the charge polarity of the toner is applied to said secondary transfer member.

* * * * *